US007038368B2

(12) United States Patent
Iwasaki et al.

(10) Patent No.: US 7,038,368 B2
(45) Date of Patent: May 2, 2006

(54) COLOR PICTURE TUBE APPARATUS HAVING A PAIR OF BAR SHAPED MAGNETS FOR CORRECTING MISCONVERGENCE DUE TO THE ROTATIONAL SHIFT OF THE ELECTRON BEAMS

(75) Inventors: Katsuyo Iwasaki, Nishinomiya (JP); Kazuhiro Sugimoto, Ibaraki (JP)

(73) Assignee: Matsushita Toshiba Picture Display Co., Ltd., Osaka (JP)

( * ) Notice: Subject to any disclaimer, the term of this patent is extended or adjusted under 35 U.S.C. 154(b) by 0 days.

(21) Appl. No.: 10/900,836

(22) Filed: Jul. 27, 2004

(65) Prior Publication Data

US 2005/0023952 A1 Feb. 3, 2005

(30) Foreign Application Priority Data

Aug. 1, 2003 (JP) ..... 2003-285325

(51) Int. Cl.
*H01J 29/46* (2006.01)
*H01J 29/70* (2006.01)

(52) U.S. Cl. ..... 313/442; 313/440; 313/441

(58) Field of Classification Search ..... 313/432–443; 335/209

See application file for complete search history.

(56) References Cited

U.S. PATENT DOCUMENTS 3,808,570 A * 4/1974 Thompson et al. ..... 335/212
4,145,677 A * 3/1979 Maruyama et al. ..... 335/212
5,347,366 A * 9/1994 Ham ..... 348/829

FOREIGN PATENT DOCUMENTS

| | | |
|---|---|---|
| EP | 0 843 333 | 5/1998 |
| EP | 0 884 756 | 12/1998 |
| JP | 1-26146 | 5/1989 |
| JP | 11-3671 | 1/1999 |
| JP | 11-260287 | 9/1999 |
| JP | 2002-25469 | 1/2002 |

* cited by examiner

*Primary Examiner*—Joseph Williams
*Assistant Examiner*—Bumsuk Won
(74) *Attorney, Agent, or Firm*—Hamre, Schumann, Mueller & Larson, P.C.

(57) ABSTRACT

On an outer circumferential surface of a neck portion of a funnel, a CPU having a pair of quadrupole magnets and a pair of bar-shaped magnets each having magnetic poles on both sides in a major axis direction are provided. The pair of bar-shaped magnets sandwich the neck portion substantially in an in-line direction of an in-line type electron gun, and are provided so that identical poles are opposed to each other, between an end plate of an insulating frame of a deflection yoke and the CPU at a distance from the end plate. In the case where a rotational shift of electron beams is caused, electron beams R and B are corrected so as to move upward and downward (or downward and upward) respectively by a quadrupole magnetic field generated by the quadrupole magnets. Then, the electron beams R and B are corrected so as to move downward and upward (or upward and downward) respectively by the quadrupole magnetic field generated by the pair of bar-shaped magnets. Thus, a misconvergence due to the rotational shift of the electron beams can be corrected.

5 Claims, 7 Drawing Sheets

FIG. 7A
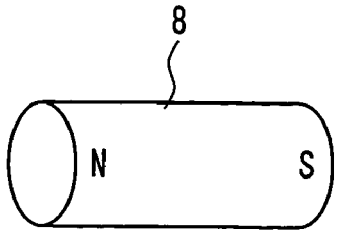
FIG. 7B
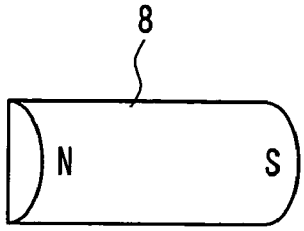
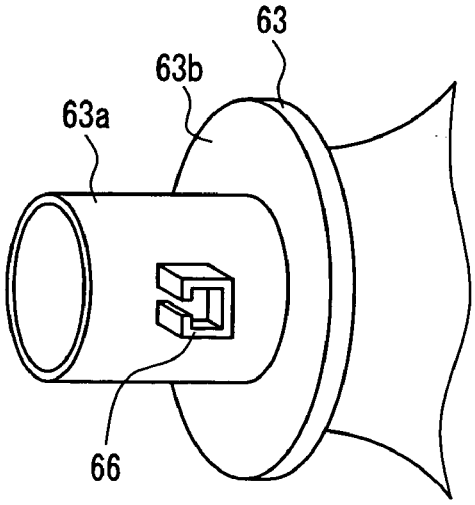
FIG. 8A
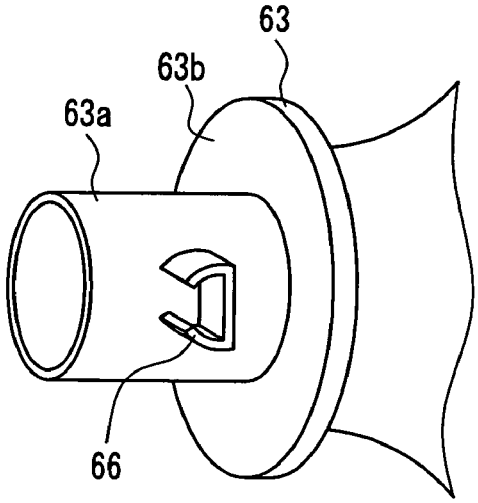
FIG. 8B

COLOR PICTURE TUBE APPARATUS HAVING A PAIR OF BAR SHAPED MAGNETS FOR CORRECTING MISCONVERGENCE DUE TO THE ROTATIONAL SHIFT OF THE ELECTRON BEAMS

BACKGROUND OF THE INVENTION

1. Field of the Invention

The present invention relates to a color picture tube apparatus with an in-line type electron gun.

2. Description of the Related Art

In a color picture tube with an in-line type electron gun, a misconvergence may occur due to a rotational shift of an electron gun during a sealing process of the electron gun and a rotational shift of a deflection yoke during a winding process and an assembly process.

Conventionally, in order to correct the above-mentioned misconvergence due to the rotational shifts, a color picture tube apparatus is known, in which a CPU (Convergence and Purity Unit) composed of each pair of dipole, quadrupole, and hexapole magnets is provided at a neck portion of a color picture tube, and a pair of annular additional quadrupole magnets are provided further on a screen side with respect to the CPU (e.g., see JP1(1989)-26146B).

For convenience of the following description, it is assumed that an axis in a horizontal direction (long side direction) passing through a tube axis and being vertical thereto is an X-axis, an axis in a vertical direction (short side direction) passing through the tube axis and being vertical thereto is a Y-axis, and the tube axis is a Z-axis. Furthermore, an in-line type electron gun refers to an electron gun in which three cathodes emitting electron beams of three colors B (blue), G (green), and R (red) are arranged in a line, and an in-line direction refers to a direction in which three cathodes are arranged. In the present specification, an in-line type electron gun will be described, in which an X-axis direction with three cathodes arranged on an X-axis is defined as an in-line direction.

In a conventional correction of a rotational shift according to JP1(1989)-26146B, as shown in FIG. 9A, a pair of annular additional quadrupole magnets 101*a*, 101*b* are rotated around a Z-axis while the rotation phases around the Z-axis are shifted from each other, whereby a quadrupole magnetic field is allowed to act on electron beams. However, the pair of additional quadrupole magnets 101*a*, 101*b* are rotated manually, so that a bisector X' of a relative open angle θ between the pair of additional quadrupole magnets 101*a*, 101*b* may not be matched with an X-axis. In this case, electron beams B, R on both sides do not move in a Y-axis direction. Consequently, a new misconvergence may be caused as shown in FIG. 9B.

SUMMARY OF THE INVENTION

The present invention has been achieved in order to solve the above-mentioned problem, and it is an object of the present invention to provide a color picture tube apparatus capable of correcting a misconvergence due to a rotational shift with a simple configuration without causing a new misconvergence.

A color picture tube apparatus according to the present invention includes: a panel with a phosphor screen formed on an inner surface; a funnel connected to the panel; an in-line type electron gun in a neck portion of the funnel; a deflection yoke provided on an outer circumferential surface of the funnel; and a CPU having a pair of quadrupole magnets provided on an outer circumferential surface of the neck portion.

The deflection yoke includes a horizontal deflection coil, a vertical deflection coil, and an insulating frame provided between the horizontal deflection coil and the vertical deflection coil. The insulating frame has an end plate vertical to a tube axis, provided between the horizontal deflection coil and the CPU.

A pair of bar-shaped magnets, each having magnetic poles on both sides in a major axis direction, sandwich the neck portion substantially in an in-line direction and are provided so that identical poles are opposed to each other, between the end plate and the CPU at a distance from the end plate.

These and other advantages of the present invention will become apparent to those skilled in the art upon reading and understanding the following detailed description with reference to the accompanying figures.

BRIEF DESCRIPTION OF THE DRAWINGS

FIG. 7A is a perspective view showing another shape of a bar-shaped magnet used in the color picture tube apparatus according to one embodiment of the present invention; and FIG. 7B is a perspective view showing still another shape of a bar-shaped magnet used in the color picture tube apparatus according to one embodiment of the present invention.

FIG. 8A is a perspective view showing a modified example of a holding mechanism in the color picture tube apparatus according to one embodiment of the present invention, and FIG. 8B is a view showing another modified example of the holding mechanism in the color picture tube apparatus according to one embodiment of the present invention.

DESCRIPTION OF THE PREFERRED EMBODIMENTS

Figure 1:
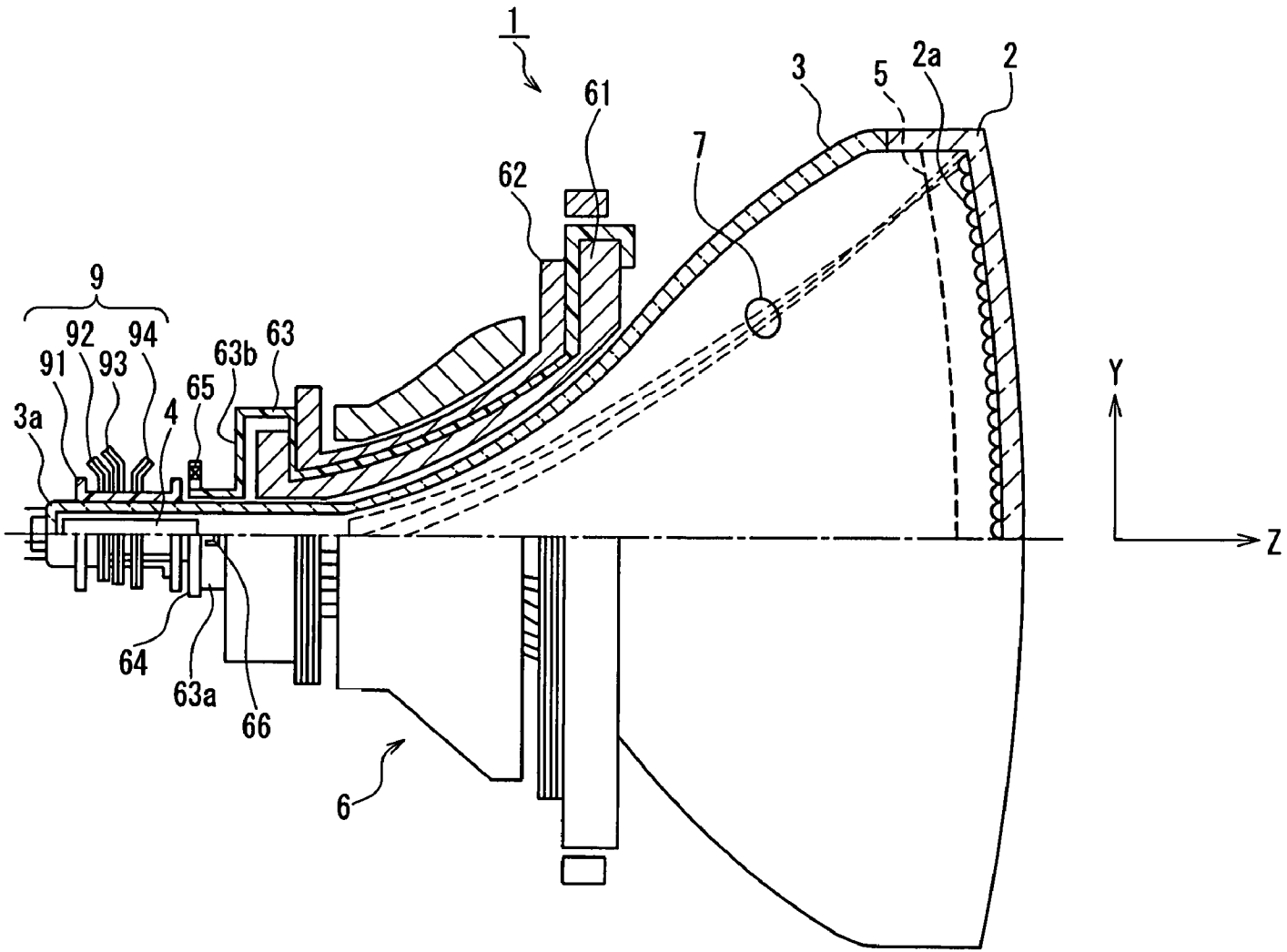
FIG. 1 is a half cross-sectional view of a color picture tube apparatus according to one embodiment of the present invention.

In the color picture tube apparatus according to the present invention, in addition to the quadrupole magnets of the CPU, a pair of bar-shaped magnets are provided so that identical poles are opposed to each other substantially in an in-line direction. Therefore, a pair of bar-shaped magnets generate a quadrupole magnetic field with an in-line direction axis (X-axis) being a central axis. This enables electron beams B, R on both sides to move in a direction vertical to the in-line direction. Therefore, the misconvergence due to a rotational shift can be corrected with a simple configuration.

Furthermore, a pair of bar-shaped magnets in a simple shape are used, resulting in a simple configuration and a low cost.

Furthermore, generally, as the distance from the end plate of the insulating frame is increased, the intensity of a deflection magnetic field generated by the deflection yoke is decreased. The arrangement of a pair of bar-shaped magnets at a distance from the end plate refers to the arrangement of a pair bar-shaped magnets at a position where the intensity of a deflection magnetic field is small. By allowing a quadrupole magnetic field generated by a pair of bar-shaped magnets to act on three electron beams in a stage before three electron beams are deflected in a horizontal direction and a vertical direction, a misconvergence can be corrected exactly over an entire screen.

Furthermore, a pair of bar-shaped magnets are placed at a distance from the end plate of the insulating frame, and the attachment and position adjustment of a pair of bar-shaped magnets are performed easily.

In recent color picture tube apparatuses, various kinds of components such as a correction coil often are mounted on the end plate. By placing a pair of bar-shaped magnets at a distance from the end plate, it is not necessary to consider the interference between the pair of bar-shaped magnets and various kinds of components placed on the end plate.

In the above-mentioned color picture tube apparatus of the present invention, preferably, a position of the pair of bar-shaped magnets in the tube axis direction is placed further on the CPU side with respect to a position where an intensity on the tube axis of a horizontal deflection magnetic field generated by the horizontal deflection coil has a maximum value $M_{Hmax}$, and in a region where the intensity on the tube axis of the horizontal deflection magnetic field is 25% or less (in particular, 20% or less) of the maximum value $M_{Hmax}$.

According to the above-mentioned configuration, a quadrupole magnetic field generated by the pair of bar-shaped magnets is allowed to act on three electron beams in a stage before three electron beams are deflected substantially, so that a misconvergence can be corrected exactly over the entire screen.

Furthermore, in the above-mentioned color picture tube apparatus of the present invention, it is preferable that the insulating frame further includes a cylindrical portion connected to the end plate on an opposite side of the horizontal deflection coil with respect to the end plate, and the pair of bar-shaped magnets are provided on an outer circumferential surface of the cylindrical portion.

According to the above-mentioned configuration, the attachment and position adjustment of the pair of bar-shaped magnets can be performed easily. Furthermore, a region for mounting various kinds of components such as a correction coil can be kept on the end plate.

In the above-mentioned case, it is preferable that holding mechanisms for holding the pair of bar-shaped magnets are provided at the cylindrical portion.

According to the above-mentioned configuration, the attachment and position adjustment of the pair of bar-shaped magnets can be performed easily.

Furthermore, in the above-mentioned color picture tube apparatus of the present invention, it is preferable that a correction amount with respect to a rotational shift of three electron beams emitted from the in-line type electron gun is adjusted by moving the pair of bar-shaped magnets substantially in an in-line direction.

As described above, the central axis of a quadrupole magnetic field generated by the pair of bar-shaped magnets is matched with an in-line direction axis. Thus, the correction amount with respect to a rotational shift is adjusted by moving the pair of bar-shaped magnets only in an in-line direction to change the intensity of a quadrupole magnetic field, whereby the central axis of a quadrupole magnetic field generated by the pair of bar-shaped magnets is not shifted from an in-line direction axis. Accordingly, the correction of a misconvergence due to a rotational shift does not cause a new misconvergence.

Furthermore, merely by moving the pair of low-cost bar-shaped magnets substantially in an in-line direction, the intensity of a quadrupole magnetic field can be adjusted easily. Thus, the misconvergence due to an individual rotational shift in an individual color picture tube apparatus can be corrected at a low cost with a simple configuration.

In the above-mentioned color picture tube apparatus of the present invention, the correction amount with respect to a rotational shift of three electron beams emitted from the in-line type electron gun may be adjusted by changing the polarization intensity of the pair of bar-shaped magnets.

Even according to the above-mentioned configuration, the central axis of a quadrupole magnetic field generated by the pair of bar-shaped magnets is not shifted from an in-line direction axis. Thus, the correction of a misconvergence due to a rotational shift does not cause a new misconvergence.

Hereinafter, one embodiment of a color picture tube apparatus of the present invention will be described with reference to the drawings.

As shown in FIG. 1, a color picture tube apparatus 1 of the present invention includes: a panel 2 having a phosphor screen 2*a*, in which respective phosphor dots (or phosphor stripes) of blue (B), green (G), and red (R) are arranged, on an inner surface; a funnel 3 connected to a rear side of the panel 2; an in-line type electron gun 4 in a neck portion 3*a* of the funnel 3; and a shadow mask 5 provided in the panel 2 so as to be opposed to the phosphor screen 2*a*. The shadow mask 5 has a function of selecting a color with respect to three electron beams 7 emitted from the electron gun 4, and is made of a flat plate in which a number of substantially slot-shaped apertures (electron beam passage apertures) are formed by etching.

A deflection yoke 6 is provided on an outer circumferential surface of the funnel 3. The deflection yoke 6 deflects the three electron beams 7 emitted from the electron gun 4 in a horizontal direction and a vertical direction, and allows the electron beams 7 to scan the phosphor screen 2*a*. The deflection yoke 6 includes a saddle-type horizontal deflection coil 61 and a saddle-type vertical deflection coil 62. A resin frame (insulating frame) 63 is provided between the horizontal defection coil 61 and the vertical deflection coil 62. The resin frame 63 maintains electrical insulation between the horizontal deflection coil 61 and the vertical deflection coil 62, and supports the deflection coils 61, 62.

On an outer circumference of the neck portion 3*a* corresponding to the position of the electron gun 4 in a tube axis direction, a CPU 9 is provided. The CPU 9 performs static convergence adjustment and purity adjustment of the electron beams 7. The CPU 9 includes a dipole magnet 92, a quadrupole magnet 93, and a hexapole magnet 94, which are attached to an outer circumference of a cylindrical supporter 91 made of a resin material. The dipole magnet 92, the quadrupole magnet 93, and the hexapole magnet 94 are composed of two annular magnets, respectively.

Figure 2A:
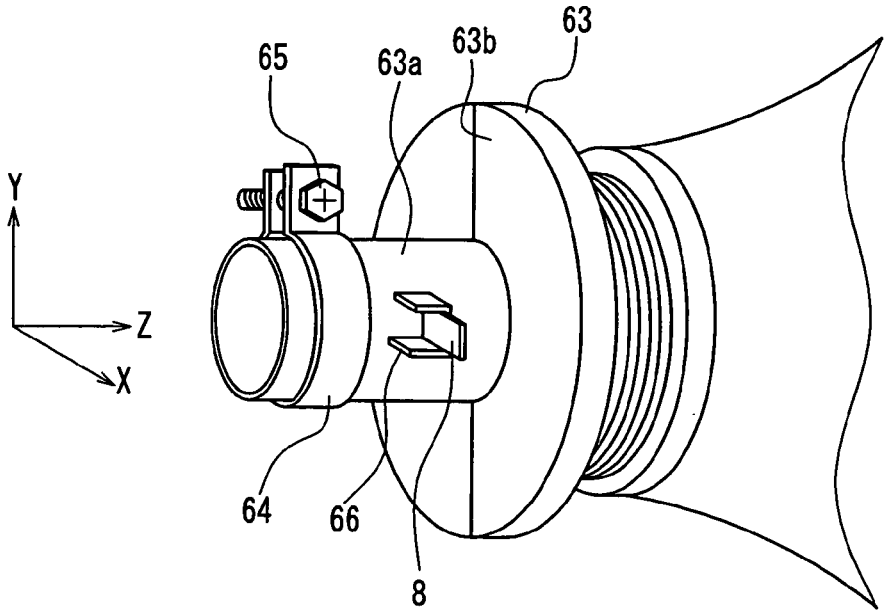
FIG. 2A is an enlarged perspective view of a neck portion and the vicinity thereof in the color picture tube apparatus according to one embodiment of the present invention.

As shown in FIGS. 1 and 2A, the resin frame 63 includes an end plate 63*b* vertical to the tube axis, provided between the horizontal deflection coil 61 and the CPU 9, and a cylindrical portion 63*a* connected to the end plate 63*b* on an opposite side of the horizontal defection coil 61 with respect to the end plate 63*b*. The cylindrical portion 63*a* is formed in a cylindrical shape with a small diameter, and fixed to the neck portion 3*a* with an annular tightening band 64 and a screw 65.

Figure 2B:
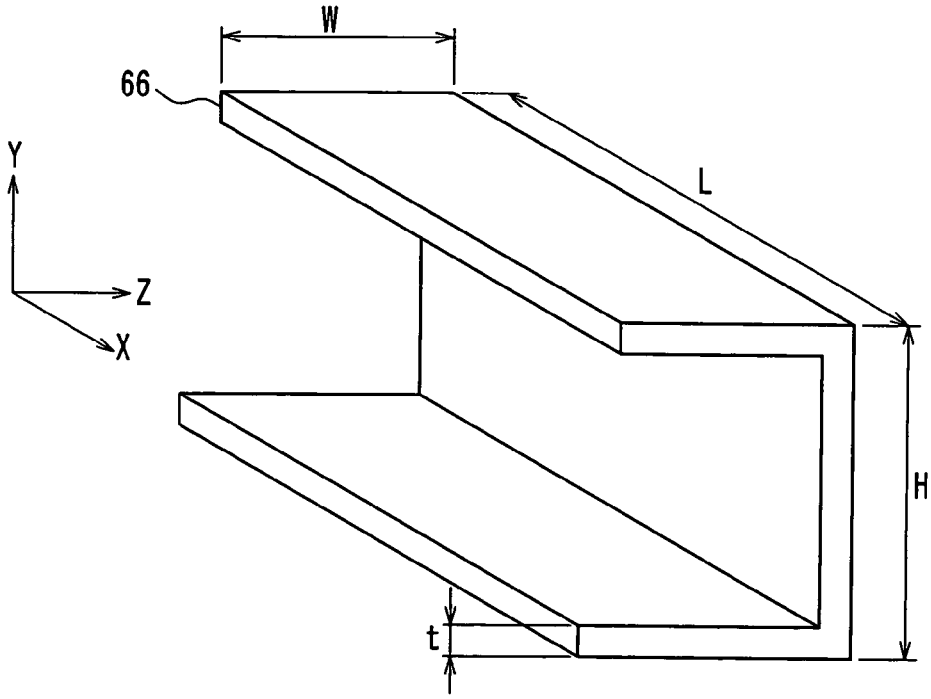
FIG. 2B is an enlarged perspective view of a holding mechanism in the color picture tube apparatus according to one embodiment of the present invention.
Figure 3:
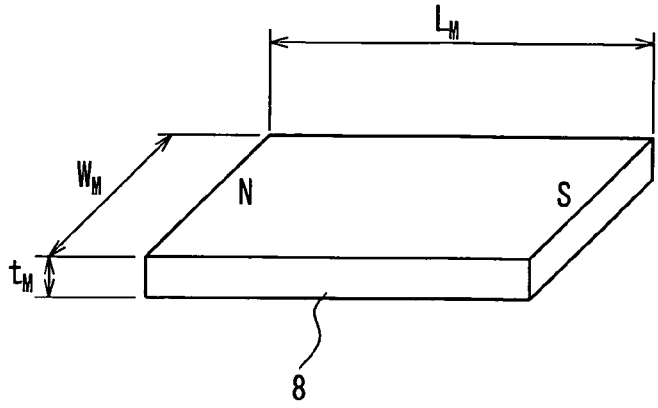
FIG. 3 is a perspective view of an exemplary bar-shaped magnet used in the color picture tube apparatus according to one embodiment of the present invention.

On an outer circumferential surface of the cylindrical portion 63*a*, a pair of holding mechanisms 66 having a substantially U-shape in cross section are formed integrally so as to be opposed to each other substantially in an X-axis direction. FIG. 2B is an enlarged perspective view of the holding mechanism 66. A pair of bar-shaped magnets 8 in a plate shape having N and S magnetic poles on both sides in a major axis direction as shown in FIG. 3 are inserted into and held in the pair of holding mechanisms 66, respectively. In this case, the pair of bar-shaped magnets 8 are held in the pair of holding mechanisms 66 so that identical magnetic poles are opposed to each other. In one example, the size of the holding mechanism 66 shown in FIG. 2B was as follows: thickness t=1.5 mm, width W=4.5 mm, length L=18.0 mm, and height H=8.0 mm. Furthermore, the size of the bar-shaped magnets 8 shown in FIG. 3 was as follows: thickness $t_M$=2.5 mm, width $W_M$=5.0 mm, and length $L_M$=12.0 mm.

Next, the correction of a rotational shift of the color picture tube apparatus according to the present embodiment will be described.

Figure 4:
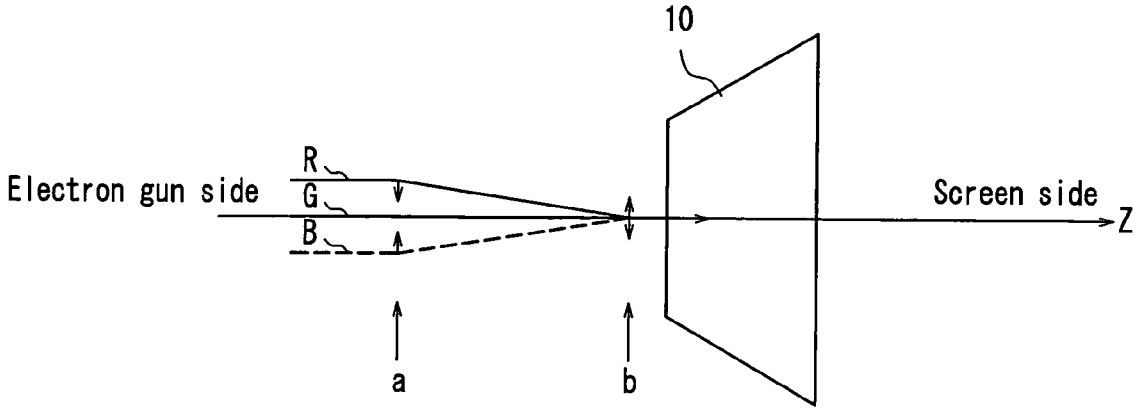
FIG. 4 is view showing the correction of a rotational shift in the color picture tube apparatus according to one embodiment of the present invention.

FIG. 4 shows a track of three electron beams projected on a YZ plane, in the case of seeing a color picture tube, in which three electron beams B, G, and R cause a rotational shift in a counterclockwise direction when seen from the phosphor screen 2*a* side, in an X-axis (in-line direction). Reference numeral 10 denotes a region of a deflection magnetic field generated by the deflection yoke 6.

In this case, first, at a point "a", the electron beam R is moved downward in a Y-axis direction and the electron beam B is moved upward in the Y-axis direction by a quadrupole magnetic field generated by the quadrupole magnet 93 of the CPU 9. Then, at a point "b", the electron beam R is moved upward in the Y-axis direction and the electron beam B is moved downward in the Y-axis direction by a quadrupole magnetic field generated by the above-mentioned pair of bar-shaped magnets 8. Consequently, the electron beams B and R shifted from a ZX plane due to the rotational shift pass along the ZX plane before entering the deflection magnetic field region 10, so that the rotational shift of the electron beams B and R can be corrected.

Figure 5A:
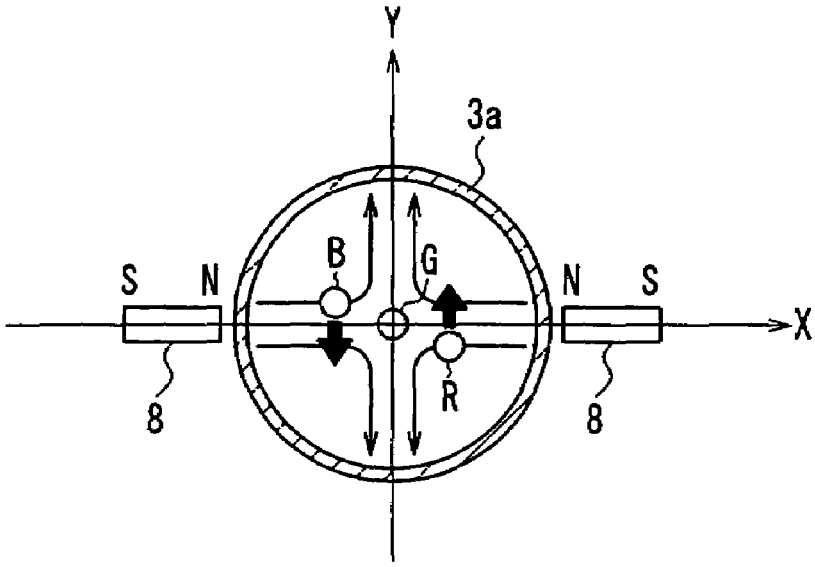
FIG. 5A is a view showing a correction magnetic field for correcting a rotational shift in a counterclockwise direction and the movement direction of electron beams by the correction magnetic field.

The correction of electron beams at the point "b" will be described in detail. In the case where a rotational shift in a counterclockwise direction is caused as shown in FIG. 4, by arranging the pair of bar-shaped magnets 8 so that their N-poles are opposed to each other as shown in FIG. 5A, a quadrupole magnetic field that moves the electron beam R upward in the Y-axis direction and moves the electron beam B downward in the Y-axis direction is generated.

Figure 5B:
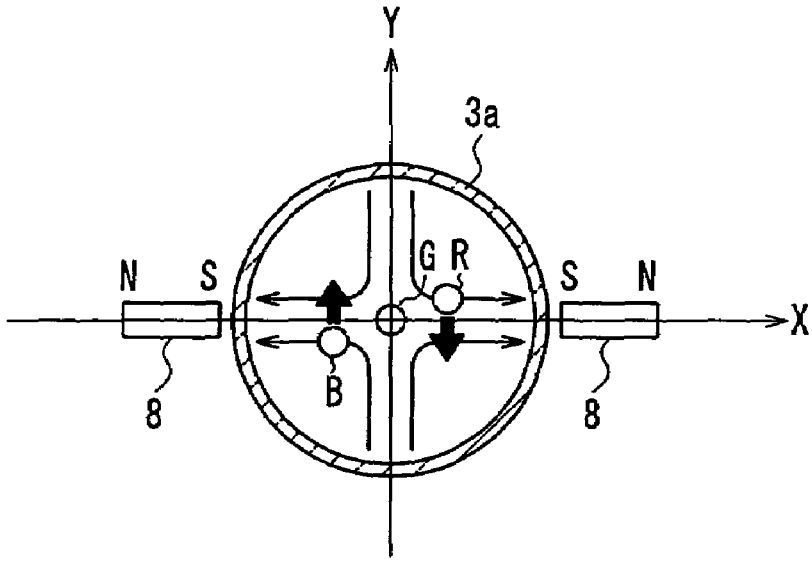
FIG. 5B is a view showing a correction magnetic field for correcting a rotational shift in a clockwise direction and the movement direction of electron beams by the correction magnetic field.

In contrast, in the case where the rotational shift is caused in a clockwise direction, at the point "a", the electron beam R is moved upward in the Y-axis direction and the electron beam B is moved downward in the Y-axis direction by the quadrupole magnet 93 of the CPU 9. At the point "b", as shown in FIG. 5B, by arranging the pair of bar-shaped magnets 8 so that their S-poles are opposed to each other, a quadrupole magnetic field that moves the electron beam R downward in the Y-axis direction and moves the electron beam B upward in the Y-axis direction is generated. Because of this, the rotational shift of the electron beams B and R can be corrected.

Furthermore, by changing the interval between the pair of bar-shaped magnets 8 inserted in the holding mechanisms 66 and the cylindrical portion 63*a* in a range of about several mm, the intensity of the quadrupole magnetic field acting on the electron beams can be varied. Because of this, an optimum quadrupole magnetic field required for the correction of a rotational shift can be generated for each color picture tube apparatus. The intensity of a quadrupole magnetic field also can be changed to a desired value even by changing the polarized amounts (polarization intensity) of the pair of bar-shaped magnets 8 respectively in the same way.

After the adjustment of the correction amount with respect to the rotational shift is finished, the bar-shaped magnets 8 are fixed to the holding mechanisms 66 with an adhesive. The means for fixing the bar-shaped magnets 8 to the holding mechanisms 66 is not limited to an adhesive. For example, other fixing means such as a double-sided tape and the like also can be used.

In the color picture tube apparatus according to the present embodiment, the misconvergence due to a rotational shift can be corrected easily by the quadrupole magnet 93 of the CPU 9 and the pair of bar-shaped magnets 8 provided separately therefrom.

Furthermore, the degree of freedom of a position in the Y-axis direction and the degree of freedom of a rotation around the Z-axis of the pair of bar-shaped magnets 8 are limited by the pair of holding mechanisms 66, and the correction amount by the quadrupole magnetic field generated by the pair of bar-shaped magnets 8 is adjusted by moving the pair of bar-shaped magnets 8 in the X-axis direction. Therefore, the central axis of the quadrupole magnetic field generated by the pair of bar-shaped magnets 8 is always matched with the X-axis, and the quadrupole magnetic field is not shifted in the Y-axis direction or rotated around the Z-axis. Thus, a new misconvergence is not caused by the correction of a misconvergence due to a rotational shift.

Figure 6:
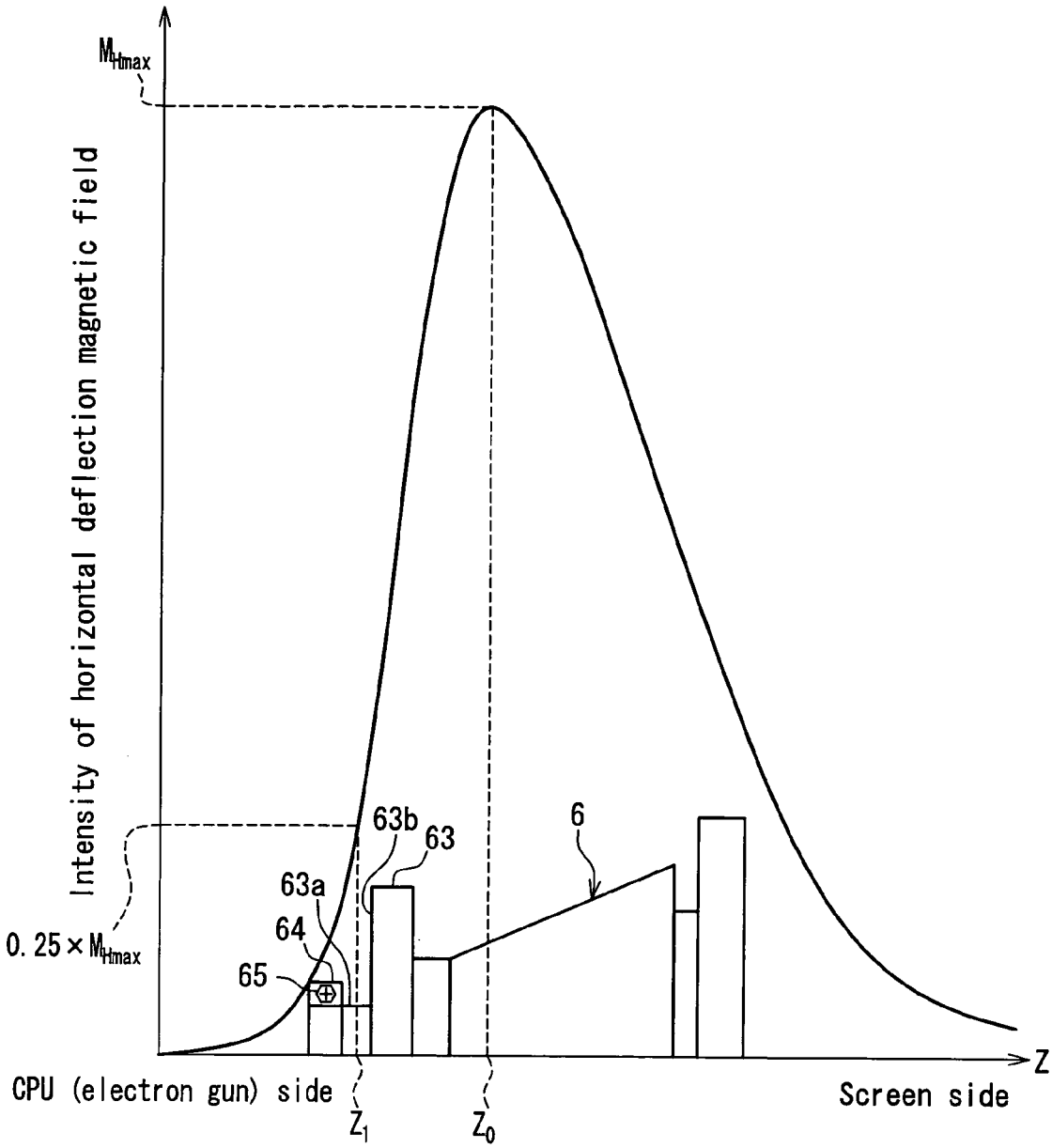
FIG. 6 is a view showing an exemplary distribution in a tube axis direction of an intensity on a tube axis of a horizontal deflection magnetic field.
Figure 9A:
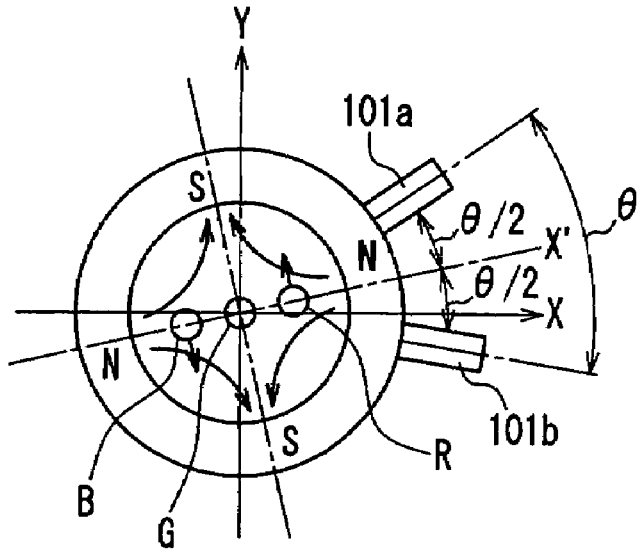
FIG. 9A PRIOR ART
FIG. 9A is a view showing the correction of a rotational shift by additional quadrupole magnets in a conventional color picture tube apparatus.
Figure 9B:
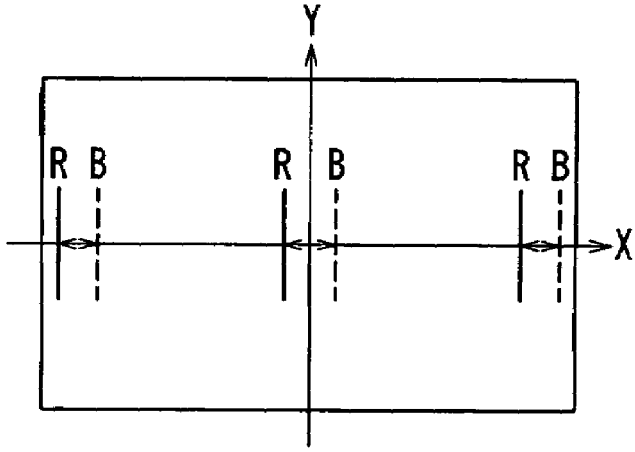
FIG. 9B PRIOR ART
FIG. 9B is a view showing a misconvergence newly caused by the additional quadrupole magnets.

In FIG. 4, the deflection magnetic field region 10 is shown in a simplified manner. However, actually, a deflection magnetic field is distributed smoothly in a tube axis direction. FIG. 6 shows an example of a distribution in the tube axis (Z-axis) direction of an intensity on the tube axis of a horizontal deflection magnetic field generated by the horizontal deflection coil 61 together with the deflection yoke 6. As shown in FIG. 6, the horizontal deflection magnetic field also acts on a region on both outer sides of the deflection yoke 6 in the tube axis direction. According to the present invention, as is apparent from the description with reference to FIG. 4, the correction of a rotational shift with respect to three electron beams in a stage before the action of the deflection magnetic field is useful for exactly correcting a misconvergence over an entire screen. Thus, according to the present invention, the pair of bar-shaped magnets 8 are provided further on the CPU 9 side (electron gun 4 side) with respect to the end plate 63*b* of the resin frame 63 at a distance from the end plate 63*b*.

When the pair of bar-shaped magnets 8 are provided at a distance from the end plate 63*b*, the following additional effects are obtained.

First, the attachment and the position adjustment of the pair of bar-shaped magnets 8 are performed easily.

Second, it is not necessary to consider the interference between various kinds of components such as a correction coil to be disposed on the end plate 63*b* and the pair of bar-shaped magnets 8. In the recent color picture tube apparatus, various kinds of components such as a correction coil often are mounted on the end plate 63*b*. When the pair of bar-shaped magnets 8 are placed at a distance from the end plate 63*b*, these components can be arranged at optimum positions on the end plate 63*b* without considering the interference with respect to the pair of bar-shaped magnets 8.

As shown in FIG. 6, when it is assumed that the intensity on the tube axis of the horizontal deflection magnetic field has a maximum value $M_{Hmax}$ at a position $Z_0$, it is preferable to set the pair of bar-shaped magnets 8 at a position $Z_1$, where the intensity on the tube axis of the horizontal defection magnetic field is 25% of the maximum value $M_{Hmax}$, placed further on the CPU 9 side with respect to the position $Z_0$, or in a region placed further on the CPU 9 side with respect to the position $Z_1$. Herein, the position of the pair of bar-shaped magnets 8 in the tube axis direction is defined by the relationship with respect to the distribution of the horizontal deflection magnetic field for the following reason: the misconvergence due to a rotational shift of electron beams appears on a horizontal axis on a screen where the vertical deflection magnetic field is 0, so that the horizontal deflection magnetic field only need be considered. By setting the pair of bar-shaped magnets 8 at the position $Z_1$ or in the region placed further on the electron gun 4 side with respect to the position $Z_1$, a quadrupole magnetic field generated by the pair of bar-shaped magnets 8 is allowed to act on three electron beams in a stage before three electron beams are deflected substantially. Therefore, a misconvergence can be corrected more exactly.

Generally, as shown in FIG. 1, the end plate 63*b* of the resin frame 63 is provided close to the end of the horizontal deflection coil 61 on the CPU 9 side. Thus, as shown in FIG. 6, the position $Z_1$ is placed further on the CPU 9 side with respect to the end plate 63*b*. For example, in a color picture tube apparatus with a screen diagonal size of 21 inches and a deflection angle of 90°, the intensity on the tube axis of the horizontal deflection magnetic field at the position of the end plate 63*b* was 36% of the maximum value $M_{Hmax}$.

As described above, in the color picture tube apparatus of the present embodiment, although the bar-shaped magnet in a plate shape as shown in FIG. 3 is used, the present invention is not limited thereto. For example, a bar-shaped magnet in a cylindrical shape as shown in FIG. 7A and a bar-shaped magnet in a semi-cylindrical shape as shown in FIG. 7B may be used. Any of the magnets have N and S magnetic poles on both sides in a major axis direction.

Thus, a great reduction in cost compared with a conventional annular magnet can be realized by using a low-cost bar-shaped magnet with a simple configuration. Furthermore, bar-shaped magnets can be attached only in the case where it is determined that the correction of a rotational shift is required, after assembly of a color picture tube apparatus. In contrast, it is difficult to attach conventional annular magnets after assembly of a color picture tube apparatus. Thus, it is necessary to previously attach the annular magnets to all the color picture tube apparatuses irrespective of whether the correction of a rotational shift is required or not. In this respect, the bar-shaped magnet of the present invention contributes to the reduction in cost, compared with the conventional annular magnet.

Furthermore, in the color picture tube apparatus according to the present embodiment, the holding mechanism 66 has a substantially U-shape in cross section as shown in FIG. 2B. However, the shape of the holding mechanism 66 is not limited thereto, as long as it can sandwich the bar-shaped magnet 8. For example, the holding mechanism 66 may have a substantially rectangular partially cut-away cross-section as shown in FIG. 8A, or a substantially "D" shaped partially cut-away cross-section as shown in FIG. 8B. Alternatively, such a cut-away portion may not be provided.

The invention may be embodied in other forms without departing from the spirit or essential characteristics thereof. The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. A color picture tube apparatus comprising: a panel with a phosphor screen formed on an inner surface; a funnel connected to the panel; an in-line type electron gun in a neck portion of the funnel; a deflection yoke provided on an outer circumferential surface of the funnel; and a convergence and purity unit having a pair of quadrupole magnets provided on an outer circumferential surface of the neck portion, wherein the deflection yoke includes a horizontal deflection coil, a vertical deflection coil, and an insulating frame provided between the horizontal deflection coil and the vertical deflection coil, the insulating frame has an end plate vertical to a tube axis, provided between the horizontal deflection coil and the convergence and purity unit, and a pair of bar-shaped magnets each having magnetic poles on both sides in a major axis direction sandwich the neck portion substantially in an in-line direction and are provided so that identical poles are opposed to each other, between the end plate and the convergence and purity unit at a distance from the end plate, wherein a position of the pair of bar-shaped magnets in the tube axis direction is placed further on the convergence and purity unit side with respect to a position where an intensity on the tube axis of a horizontal deflection magnetic field generated by the horizontal deflection coil has a maximum value $M_{Hmax}$, and in a region where the intensity on the tube axis of the horizontal deflection magnetic field is 25% or less of the maximum value $M_{Hmax}$.

2. The color picture tube apparatus according to claim 1, wherein the insulating frame further comprises a cylindrical portion connected to the end plate on an opposite side of the horizontal deflection coil with respect to the end plate, and the pair of bar-shaped magnets are provided on an outer circumferential surface of the cylindrical portion.

3. The color picture tube apparatus according to claim 2, wherein holding mechanisms for holding the pair of bar-shaped magnets are provided at the cylindrical portion.

4. The color picture tube apparatus according to claim 1, wherein a correction amount with respect to a rotational shift of three electron beams emitted from the in-line type electron gun is adjusted by moving the pair of bar-shaped magnets substantially in an in-line direction.

5. The color picture tube apparatus according to claim 1, wherein a correction amount with respect to a rotational shift of three electron beams emitted from the in-line type electron gun is adjusted by changing a polarization intensity of the pair of bar-shaped magnets.

* * * * *